US011548714B2

(12) United States Patent
Herard

(10) Patent No.: US 11,548,714 B2
(45) Date of Patent: Jan. 10, 2023

(54) VACUUM EXOSKELETAL ENCLOSURE FOR STORING HIGH END FOOT WARE

(71) Applicant: James Herard, Miami, FL (US)

(72) Inventor: James Herard, Miami, FL (US)

( * ) Notice: Subject to any disclaimer, the term of this patent is extended or adjusted under 35 U.S.C. 154(b) by 0 days.

(21) Appl. No.: 17/390,913

(22) Filed: Jul. 31, 2021

(65) Prior Publication Data

US 2022/0041365 A1 Feb. 10, 2022

Related U.S. Application Data

(60) Provisional application No. 63/062,808, filed on Aug. 7, 2020.

(51) Int. Cl.

| | |
|---|---|
| ***B65D 81/20*** | (2006.01) |
| ***B65D 25/54*** | (2006.01) |
| ***B65D 85/18*** | (2006.01) |
| ***B65D 8/00*** | (2006.01) |

(52) U.S. Cl.

CPC ..... *B65D 81/2038* (2013.01); *B65D 11/02* (2013.01); *B65D 25/54* (2013.01); *B65D 81/2015* (2013.01); *B65D 85/187* (2013.01)

(58) Field of Classification Search

CPC ..... B65D 81/2038; B65D 81/2007; B65D 85/187; B65D 81/2015; B65D 11/02

USPC ..... 206/524.8, 1.5, 829; 24/30.5 P; 220/592.2, 592.03, 378, 4.27, 4.21–4.23, 220/4.25, 231

See application file for complete search history.

(56) References Cited

U.S. PATENT DOCUMENTS

| | | | | |
|---|---|---|---|---|
| 3,620,409 | A * | 11/1971 | Milton | F16K 24/04 220/745 |
| 4,628,959 | A * | 12/1986 | Parker | B60T 13/52 137/526 |
| 5,755,311 | A * | 5/1998 | Younessian | E05B 65/5238 190/122 |
| 5,865,037 | A * | 2/1999 | Bostic | F25D 23/062 62/371 |
| 10,759,588 | B1 * | 9/2020 | Lobisser | B65D 19/02 |
| 2002/0157972 | A1 * | 10/2002 | Gallo | A61J 1/00 206/232 |
| 2012/0223087 | A1 * | 9/2012 | Wang | B65D 45/22 220/592.2 |
| 2013/0026167 | A1 * | 1/2013 | Kusz | C12M 27/02 220/212.5 |
| 2013/0292291 | A1 * | 11/2013 | Lui | B65D 81/2015 206/524.8 |
| 2016/0145035 | A1 * | 5/2016 | Bates | B65D 85/187 206/292 |
| 2018/0079565 | A1 * | 3/2018 | Seibert | B65D 83/0805 |
| 2019/0144164 | A1 * | 5/2019 | Breyburg | B65D 43/22 220/495.01 |

(Continued)

*Primary Examiner* — Rafael A Ortiz

(74) *Attorney, Agent, or Firm* — Cynthia S. Lamon; Lamon Patent Services

(57) ABSTRACT

An enclosure is provided for encapsulating an article of footware, the enclosure assembled from a first molded form to cover a portion of the article and a second molded form to cover the rest of the article the forms including interfacing edges assembled together over a vacuum seal to produce an air tight body, the body having a vacuum port enabling a vacuum draw on the air tight body, the vacuum pressure sustained within the air tight body after vacuum disconnect and releasable by a release mechanism.

11 Claims, 6 Drawing Sheets

(56) References Cited

U.S. PATENT DOCUMENTS

2019/0152677 A1* 5/2019 Hoyt ..... B65D 43/165

* cited by examiner

VACUUM EXOSKELETAL ENCLOSURE FOR STORING HIGH END FOOT WARE

CROSS-REFERENCE TO RELATED DOCUMENTS

The present invention claims priority to a U.S. provisional patent application entitled "Vacuum Exoskeletal Enclosure for Storing High End Foot Ware" filed on 63/062,808, filed on Aug. 7, 2020, disclosure of which is included in this specification at least by reference.

BACKGROUND OF THE INVENTION

1. Field of the Invention

The present invention is in the field of protective packaging for apparel and pertains particularly to a vacuum sealable protective enclosure for encapsulating and storing high end footware.

2. Discussion of the State of the Art

In the art of fashion there are many different types and physical shapes and functions of footware. Footware may be defined as any article of fabrication a person may wear on their feet for walking, dancing, or other functions. Footware may include all types of dress shoes, dress sandals, sports shoes, leather boots, etc.

Typically, footware is sold or shipped in boxes in which the footware may be separated (left, right) within the box by tissue paper or a cardboard separator. Often shoes placed together in a box may become scuffed by repeatedly making contact. Shoes that are left out such as on a shelf in a closet or lying on a floor may collect dust, mildew, mold, dust mites, and may also be potential hiding places for spiders and other creatures.

Shoe bags are available in the art for some types of footware. In some cases, shoes held in a same shoe bag may become scuffed from repeated placement of those shoes in the shoe bag. A pair of shoes may be individually bagged and then placed in a third bag to avoid scuffing. However, shoe bags can become wet and transmit moisture to the contained footware.

Therefore, what is clearly needed is an exoskeleton enclosure for an article of footware that reduces or eliminates the prospect of scuffing, or other environmental damage from exposure to damp conditions.

BRIEF SUMMARY OF THE INVENTION

According to an embodiment of the present invention, an enclosure is provided for encapsulating an article of footware, the enclosure including a first molded form shaped in manufacture to cover at least a portion of the article of footware, the first form closed at one side and including a peripheral free edge, a second molded form shaped in manufacture to cover the remaining portion of the article of footware, the second form closed at one side and including a peripheral free edge, the first and second forms align-able to interface at the free edges, a first peripheral connector strap formed to or otherwise affixed to a peripheral free edge of the first or the second molded form, the first connective strip having a wall thickness and a uniform width, and a seal ring formed thereon or otherwise affixed thereto along the interfacing edge of the strip, a second peripheral connector strip formed to or otherwise affixed to the remaining peripheral free edge of the opposing molded form, the second connective strip having a uniform outside thickness and a peripheral groove formed therein and having a uniform width, and a uniform depth, the second connector strip further including a peripheral lock groove formed along the bottom of the peripheral groove, the lock groove having a uniform diameter large enough to catch and seat the peripheral seal ring on the first peripheral connector strip, a vacuum port including a seal and vacuum pressure release mechanism fixed onto the first or second molded form, the vacuum port accepting connection of a hose fitting in turn connected to a vacuum hose of a vacuum pump.

In a preferred embodiment, the first and second molded forms are molded plastic forms of suitable rigidity to maintain form under an applied vacuum pressure. In one embodiment, the article of footware is one of a tennis shoe, a high heel shoe, a boot, or a sandal. In one embodiment, the molded forms are fabricated of a translucent polymer or composite thereof. In one embodiment, the article of footware is a left foot article or a right foot article of a pair of footware articles. In one embodiment, the vacuum release mechanism is a spring-loaded button that when pressed breaks contact with the vacuum seal in the port.

In another embodiment, the enclosure further includes a plurality of closure straps of a uniform length, width, and thickness, the closure straps anchored by hinge to the first molded form or to second molded form, the length dimension enough to enable the straps to extend from the anchoring point on one molded form to the opposite molded form. In a variation of this embodiment, individual ones of the plurality of closure straps are anchored by hinge to the first molded form and to the second molded form. In this embodiment the closure straps each include a snap button disposed to and fixed to the free end thereof and wherein the molded form across from the anchoring points of the closure straps include snap recesses installed thereon to accept the snap buttons on the closure straps.

In one embodiment, the first and second peripheral connector strips are plastic welded onto the peripheral edges of the first and second molded forms. In one embodiment, the enclosure of claim 1, further includes a hinge mounted to the rear surface of the first molded form at one side of the hinge and to the rear surface of the second molded form at the opposing side of the hinge. In this embodiment, the hinge is a metallic hinge installed to the molded forms by conventional screws.

According to another embodiment of the present invention, a method is provided for storing an article of footware in a vacuum state in an enclosure, the enclosure assembled from a first and second molded form, the forms optionally attached to a hinge element, the forms including a tongue-in-groove interface enabling an air tight exoskeletal body when assembled, the body including a sealable vacuum port accepting connection of a hose fitting in turn connected to a vacuum hose of a vacuum pump including steps (a) separating the molded forms open to accept an article of footware, (b) placing the article of footware in correct orientation relative to the enclosure shape profile between the molded forms, (c) urging the molded forms closed over the article of footware, (d) aligning the tongue-in-groove interface and pressing it together until the peripheral interface is closed and sealed forming the airtight exoskeletal body, (e) connecting the vacuum pump by hose and vacuum fitting to the vacuum port, (f) drawing a vacuum on the airtight exoskeletal body formed at step (d), and (g) dis-connecting the vacuum fitting from the vacuum port leaving a state of vacuum inside the airtight exoskeletal body formed at step (d).

In one aspect of the method, the tongue and groove interface includes a seal ring seated in a lock groove providing the airtight seal about the periphery of the separable forms. In one aspect, in step (b) the article of footware is one of a tennis shoe, a high heel shoe, a boot, or a sandal. In one aspect, in step (b) the article of footware is a left foot article or a right foot article of a pair of footware articles. In one aspect of the method, the tongue-in-groove interface includes a peripheral seal ring on a first connector strip that seats within a peripheral lock groove in a second connector strip. In one aspect, the method further includes a step (h) for latching the molded forms across the tongue-in-groove interface using closure straps anchored by hinge on one of the molded forms and secured by snap recess and snap button at the opposing molded form.

DETAILED DESCRIPTION OF THE INVENTION

In various embodiments described in enabling detail herein, the inventor provides a unique vacuum enclosure for encapsulating an article of footware. The present invention is described using the following examples, which may describe more than one relevant embodiment falling within the scope of the invention.

It is a goal of the present invention to provide an enclosure for protecting an article of footware from scuffing, dust accumulation, atmospheric humidity, mold spores, fungus, and other contaminants that portend to humidity. Additionally, materials commonly used in manufacturing of foot ware, specifically sport shoes, include rubbers, silicone and polymer based materials that suffer from hydrolysis over time causing destruction and even crumbling of this material over time. It is a goal of the present invention to include a hermetically sealed encasement preventing humidity and oxygen from entering an environment created within the enclosure. It is another goal of the present invention to provide a vacuum state to a vacuum enclosure installed around an article of footware without significantly increasing the three-dimensional space taken up by the article of footware. It is a further goal of the invention to provide a right and left enclosure for the right and left articles of footware.

Figure 1A:
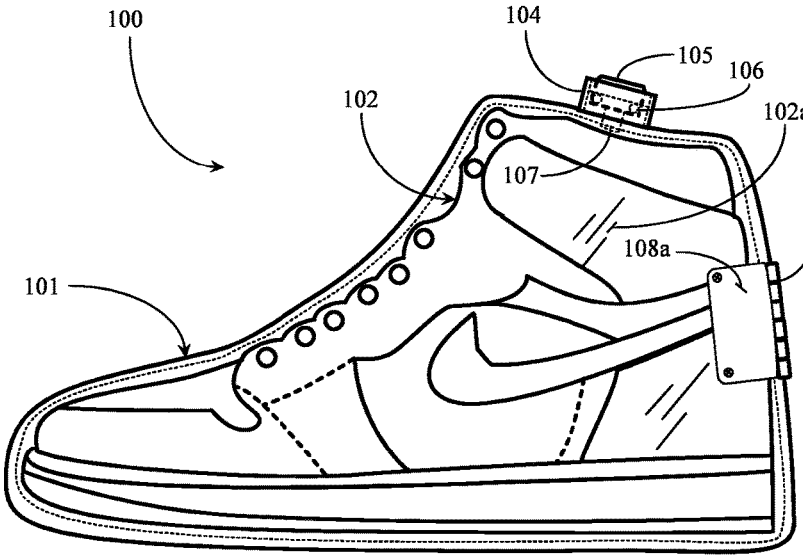
FIG. 1A is a side-elevation view a high-top tennis shoe encapsulated in a vacuum footware enclosure according to an embodiment of the present invention.

FIG. 1A is a side-elevation view a high-top tennis shoe 102 encapsulated in a vacuum footware enclosure 100 according to an embodiment of the present invention. Footware enclosure 100 has a two-piece body 101 made up of a half-shell 102*a* and an opposing half shell 102*b* (not visible). Body 101 forms an exoskeletal (materially resilient) enclosure assembled from the half shells 102*a* and 102*b* that may be tandemly or individually formed by plastic molding. Body 101 may be fabricated of a resilient plastic or polymer composite material that may be resilient enough to hold general form under vacuum pressure. The exoskeletal characteristics of body 101 are of an article characterized as an encapsulating enclosure that has a form substantially the same in three-dimensional shape as the article of footware, in this case, tennis shoe 102 that may fit inside. In practice of the invention, a left-foot footware enclosure like footware enclosure 100 may be provided for an article of footware fitting the left foot and a right-foot footware enclosure may be provided for an article of footware fitting on the right foot. Half shell 102*a* may be molded in the general form of the outside of tennis shoe 102 whereas half shell 102*b* (not visible) may be molded to the unique shape of the instep side of tennis shoe 102. In this view, tennis shoe 102 is a left-foot article and vacuum enclosure 100 is a left-foot footware enclosure.

Vacuum enclosure 100 may include a vacuum port 104 adapted to be accessed by a standard vacuum hose fitting of a vacuum pump (not shown but assumed present). Vacuum port 104 may be a stem port including a stem 107 and button 105 for releasing vacuum pressure within enclosure 100. Vacuum port 104 may include a vacuum seal 106 (O-ring seal) and a spring (not visible) for maintaining physical contact against seal 106 by a pressure release mechanism in the fashion of a standard vacuum valve. A user may pump air out from the inside of vacuum enclosure 100 with a footware article inside to remove humidity and leave enclosure 100 in a state of vacuum during storage of the article of footware. A user may release vacuum pressure within vacuum enclosure 100 by depressing button 105 in port 104 against spring pressure to break physical contact between the button surface and seal 106.

Half shell 102*a* and 102*b* (not visible) may be held together, in one embodiment, by a piano hinge type assembly 103 to enable hinged separation of the half shell components to remove and replace footware to be stored. Piano hinge assembly 103 may include opposing hinge plates 108*a* and 108*b* (not visible). Hinge 103 may be a metal hinge or a plastic molded hinge without departing from the spirit and scope of the present invention. The hinge plates like plate 108*a* may conform to the general curvature or shape of the back of the exoskeletal body 101 that conforms generally with the shape of the back side of tennis shoe 102. Hinge assembly 103 is used in this embodiment to connect the separate half shell components together at the hinge so that the half shells may be urged apart and urged together via the hinge.

Figure 1B:
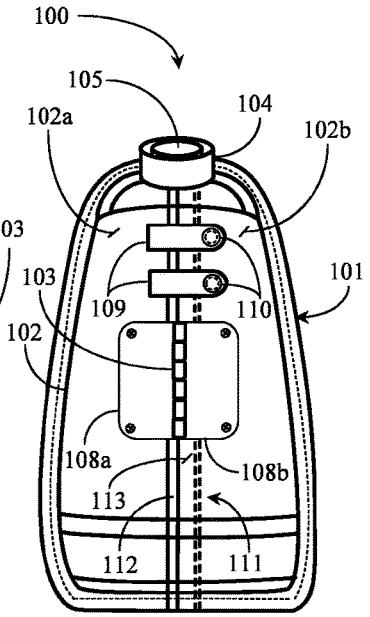
FIG. 1B is a rear-elevation view of the high-top tennis shoe of FIG. 1A encapsulated in the vacuum footware enclosure of FIG. 1A.

FIG. 1B is a rear-elevation view of high-top tennis shoe 102 of FIG. 1A encapsulated in vacuum footware enclosure 100 of FIG. 1A. Exoskeletal body 101 comprises half shell 102*a* and half shell 102*b*. Tennis shoe 102 fits snugly, or in a form fit manner within vacuum enclosure 100. Body 101 may be assembled by aligning and urging half shells 102*a* and 102*b* together. Vacuum enclosure 100 includes assembled exoskeletal body 101 and the additional vacuum port and any latching hardware.

In one embodiment, the half shell parts are secured together via aligning and connection of a tongue-in-groove interfacing rim 111 comprising a tongue strip 112 disposed along the interfacing edge of half shell 102*a* and a groove strip 113 disposed along the interfacing edge of Half shell 102*b*. In one embodiment, the tongue strip 112 is inserted into the groove strip 113 and may snap in at the bottom of the groove strip. Interfacing rim 111 may run from the rear bottom edge of hinge 103 at a point near center around the long perimeter defining the interfacing rim 111 up to vacuum port 104 and from vacuum port 104 down to the top of hinge 103.

In one embodiment, half shell 102*a* and half shell 102*b* share contiguous material covered by the collective footprint of hinge 103 and hinge plate 108*a* and 108*b*. In this embodiment, vacuum port 104 may be welded to or otherwise installed in a fixed position to one of the half shells, for example, to half shell 102*b* but may not be fixedly connected to half shell 102*a*. In such an embodiment, a vacuum seal may be provided at the radius portion of half shell 102*a* interfacing with port 104 to ensure vacuum integrity about the port when the vacuum enclosure is closed and latched.

In one embodiment, vacuum port 104 may be disposed entirely on half shell 102*b*, or entirely on half shell 102*a* so that the interfacing rim 111 may extend along the entire long perimeter of exoskeletal body 101 terminating at hinge 103 at top and at bottom. Hinge 103 may be a metallic hinge or a polymer hinge including a hinge plate 108*a* and a hinge plate 108*b* attached to respective half shells 102*a* and 102*b* by screws or other fasteners. In this embodiment, the half shells 102*a* and 102*b* are connected together by tongue-in-groove interfacing rim 111 occupying the entire long perimeter of body 101 and extending beneath the collective footprint of hinge 103 including hinge plates 108*a* and 108*b*. The polymer material used in molding the parts may be resilient enough to hold form and not collapse or wrinkle under vacuum but may remain flexible enough to bend or flex along with the operation of hinge 103. In one embodiment, hinge 103 may be plastic welded to the half shells or plastic molded with the half shells 102*a* and 102*b* in a same mold at a same molding operation.

In one embodiment, elongate closure straps referenced herein as closure straps 109 may be provided and may be anchored in a pivotal fashion on one of the half shells, for example, half shell 102*a* whereby the straps 109 may include snap buttons that fit into snap recesses 110 disposed strategically (based on length of straps) on the opposite half shell, for example, half shell 102*b* as depicted in this view. Closure straps 109 may be resilient polymer straps having a small hinge adaptation at the anchoring end enabling the straps to pivot away from the surface of the half shell, reach over interfacing rim 111 and be secured to snap recesses 110 to further latch the half shells together. In one embodiment there are several to many closure straps 109 and snap recesses 110 disposed along the seam or interfacing rim 111 between the half shells. No closure straps 109 are depicted in FIG. 1B but may be assumed present both in front and at rear of body 101 and may be disposed also along the bottom of body 101 without departing from the spirit and scope of the invention.

Figure 2A:
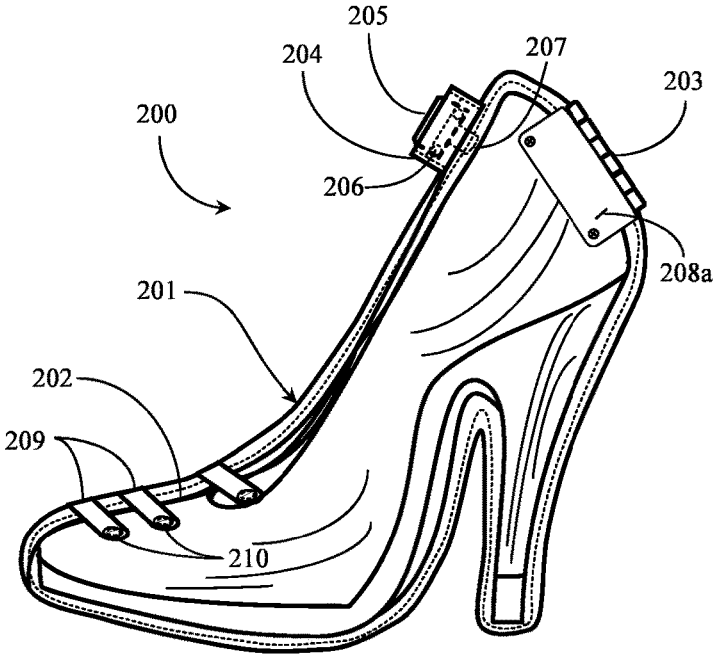
FIG. 2A is a side-elevation view a high heeled shoe encapsulated in a vacuum footware enclosure according to an embodiment of the present invention.

FIG. 2A is a side-elevation view a high heeled shoe 202 encapsulated in a vacuum footware enclosure 200 according to an embodiment of the present invention. Vacuum enclosure 200 includes an exoskeletal body form 201 comprising a plastic-molded half shell 202*a* and a half shell component 202*b* (not visible) aligned and pressed together to form an airtight enclosure. Enclosure 200 may be molded according to the rough shape and proportion of high heeled shoe 202. Like vacuum enclosure 100 for enclosing tennis shoe 102 of FIG. 1A, vacuum enclosure 200 for enclosing high heeled shoe 202 includes a vacuum port 204, a vacuum release button 205, a protruding vacuum stem 207, a vacuum seal 206 to seal the port and a spring (not visible) to enable the port to break seal by depressing button 205.

In this view, high heel shoe is a left heel and body 201 is adapted to enclose a left heel. It may be appreciated by one with skill in the art of footware that the variety of shapes of footware of differing designs calls for custom designs of vacuum enclosures like enclosure 100 of FIG. 1A and enclosure 200 of this embodiment. The granularity in conforming with the height, width, and length of a shoe boot or sandal may depend at least in part on general footware sizes of footware to be stored. For example, if high heel 202 is a size 7 shoe, body 201 may be formed to be able to enclose a high heel shoe from size 6 to size 8, where size 7 is a nominal size or in the middle of a size range that body 201 can cover. Likewise, three-dimensional form of an article of footware may dictate the three-dimensional form of the exoskeletal body 201.

In this view, a piano hinge 203 is analogous to piano hinge 103 of FIG. 1A. Hinge 203 is disposed vertically in this embodiment, at the rear of high heel shoe 202, but presents at a forward slant conforming with the shape of high heel shoe 202. Hinge 203 may be disposed elsewhere relative to form of a high heel as well without departing from the spirit and scope of the present invention. In one embodiment, hinge 203 may be disposed vertically to the rear of the heel portion of body 201, on the front sloped portion of body 201, or on the bottom ball portion of body 201.

Vacuum enclosure 200 may include a vacuum port 204 adapted to be accessed by a standard vacuum hose fitting of a vacuum pump (not shown but assumed present). Vacuum port 204 may be a stem port including a stem 207 and a vacuum pressure release button 205 and a spring mechanism (not visible) for releasing vacuum from within enclosure 200.

Figure 2B:
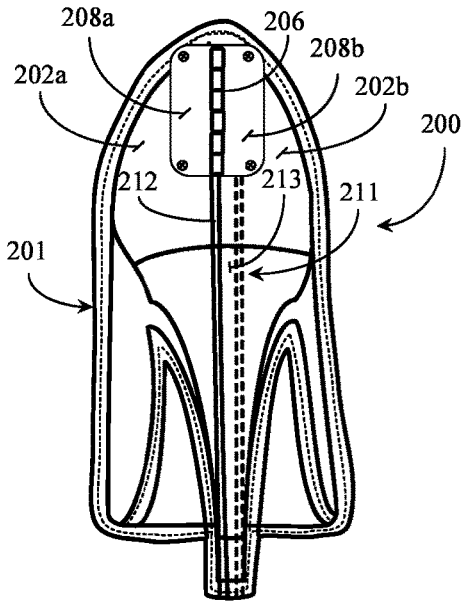
FIG. 2B is a rear-elevation view of the capsuled high heel shoe of FIG. 2A.

FIG. 2B is a rear-elevation view of high heeled shoe 202 of FIG. 2A encapsulated in vacuum footware enclosure 200 of FIG. 2A. Vacuum enclosure 200 includes an exoskeletal body 201 formed by aligning and urging together a half shell 208*a* and a half shell 208*b* along a tongue-in-groove interface 211 comprising of a tongue strip 212 and a groove strip 213 wherein the tongue portion 211 aligns with and is inserted into the groove in groove strip 213 as is described further above relative to tongue-in-groove interfacing rim 111 of enclosure 100 of FIG. 1B.

In this view, piano hinge 203 includes hinge plates 208*a* and 208*b* that may conform to the curved rear surface of exoskeletal body 201. Tongue-in-groove interface 211 may extend about the long perimeter of vacuum footware enclosure 200 at rough center from the bottom of hinge 203 and extending along the rear and front side of the pointed heel portion of exoskeletal body 201, along the sole portion of the form back around to the top of hinge 203. Vacuum port 204 of FIG. 2A is not visible in this view because it is disposed on the front of body 201 below the elevation of the heel portion of the exoskeletal body 201.

Vacuum enclosure 200 is materially and operationally the same as or remarkably similar to those characteristics of vacuum enclosure 100 of FIG. 1B save for a difference in shape required for different footware profiles. In a preferred embodiment of the present invention, exoskeletal body 201 may be unlatched and separated along the tongue-in-groove interface. Thus, the half shells 202*a* and 202*b* may be separated along the swing path of hinge 203 wide enough to insert a high heel shoe therein for storage.

Figure 3A:
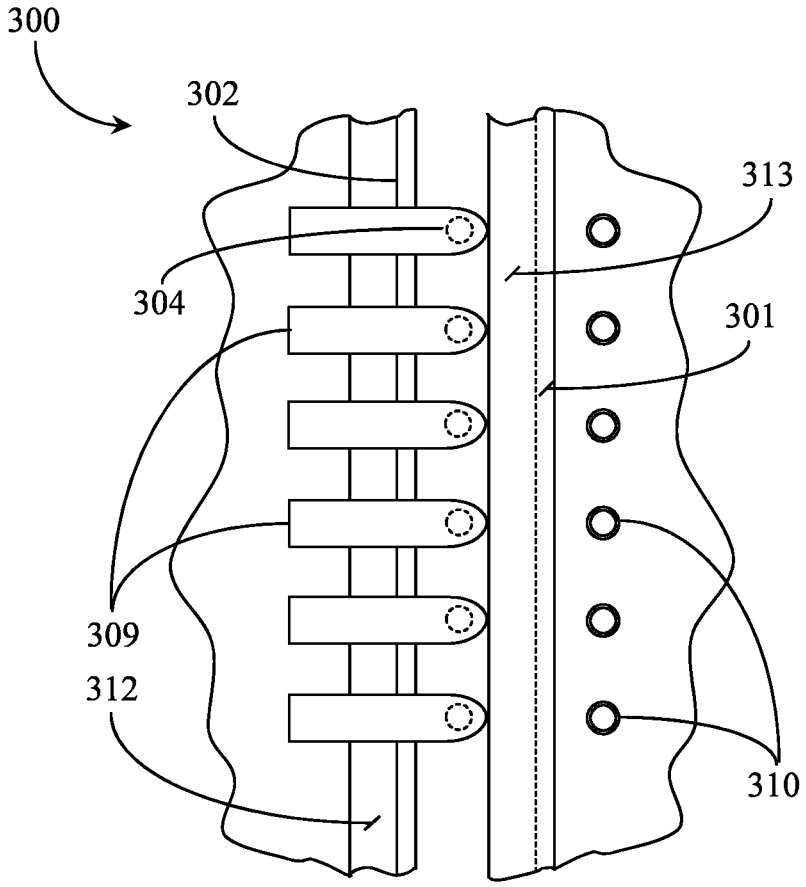
FIG. 3A is a partial view of a tongue-in-groove sealing interface with overlapping closure straps analogous to the closure straps of FIG. 1B and FIG. 2A according to an embodiment of the present invention.

FIG. 3A is a partial view 300 of a tongue-in-groove sealing interface with overlapping closure straps analogous to the tongue-in-groove sealing interfaces and closure straps of FIG. 1B and FIG. 2A according to an embodiment of the present invention. In one embodiment, interface 311 (analogous to interfacing rim 111, FIG. 1B and 211, FIG. 2B) is depicted unlatched and separated. Tongue strip portion 312 is analogous to tongue strip portions 212 of FIG. 2B and 112 of FIG. 1B described further above.

Tongue strip 312 may include an elongate sealing ring 302 disposed along the interfacing end of the tongue strip. Ring 302 may be formed (typically annular form) to fit into an interfacing lock groove 301 disposed peripherally at the bottom of the peripheral tongue groove of groove strip 313. Sealing ring 302 may be fabricated from silicone rubber, flexible but resilient plastics, or other suitable materials epoxied to or otherwise applied to the free edge of tongue 312.

In one embodiment, sealing ring 302 is more flexible than tongue strip 312 and may function as a sealing material like silicone rubber gasket material for example, that is flexible enough to be urged into the peripheral groove 301 in groove strip 313 and form a vacuum seal at that point all along the peripheral interface between the half shells.

Lock groove 301 may be disposed to the bottom and to one side of groove strip 313 to catch sealing ring 302 when tongue is fully inserted into the tongue groove to the bottom. Seal ring 302 may have shape matching lock groove 301 and forms a seal all around the formed body. Especially under applied vacuum from a vacuum pump. In addition to the seal afforded by seal ring 302 interfacing with lock groove 301, closure straps 309 (analogous to closure straps 109 FIG. 1B) may be provided to reach over rim 311 in a closed state and be snapped into snap recesses 310 (analogous to recesses 110 FIG. 1B). Snap buttons 304 on the bottom side of the strap ends may snap into recesses 310 to latch the half shells together and secure the tongue-in-groove interface so the seal ring 302 remains in lock groove 301.

Figure 3B:
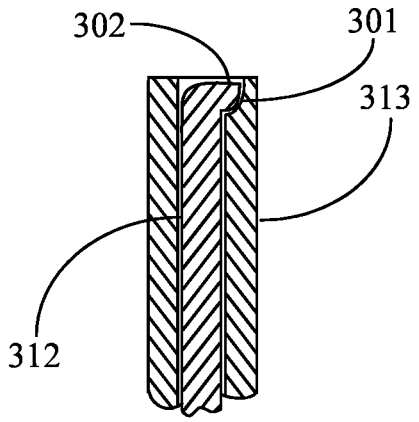
FIG. 3B is a partial section view of the tongue-in-groove sealing interface of FIG. 3A in a closed position.

FIG. 3B is a partial sectioned view of the tongue-in-groove sealing interface 311 of FIG. 3A in a closed position. Interface 311 is depicted in this view as closed, rotated, and sectioned. Tongue strip 312 may be inserted into groove strip 313 wherein seal ring 302 expands into lock groove 301 forming a vacuum seal all around the interfacing edges of the two half shells. Groove strip 313 and tongue strip 312 may be attached to the interfacing peripheral edges of each of the half shells in a mold operation. In one embodiment the components may be jigged and heat-sealed or welded to the half shell edges.

In another embodiment, another type of seal mechanism or architecture may be employed without departing from the spirit and scope of the present invention. For example, interface 311 may be a traditional clam-shell interface formed orthogonally conforming to the general vertical profile of the connected exoskeletal half shells. In this embodiment a peripheral depression is formed on one face and a corresponding ridge is formed on the opposite face. A rubber seal may be inserted into the peripheral depression to seal against the peripheral ridge. In both described interface architectures, application of low-grade vacuum urges the opposing half shells together firmly against the sealing component.

Figure 4:
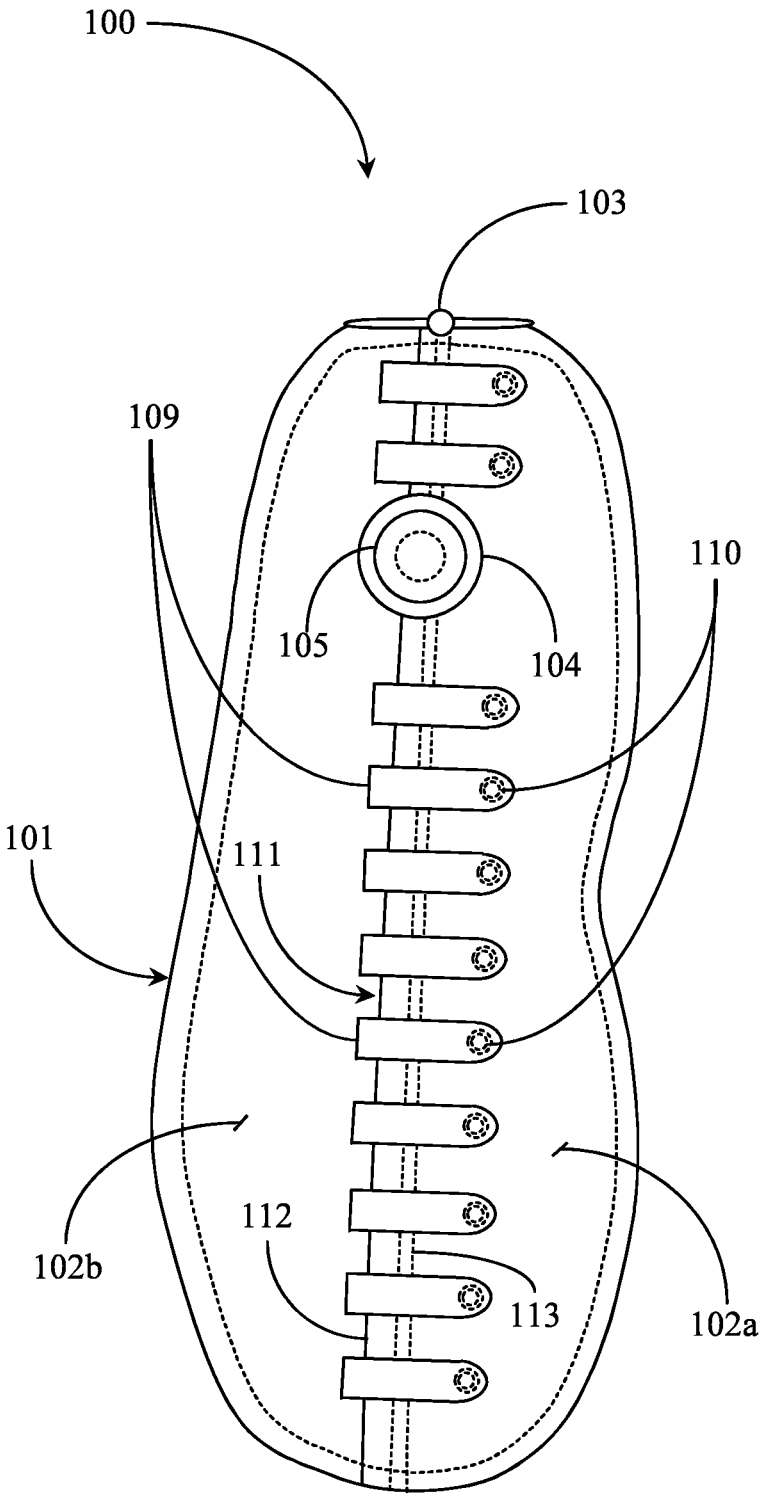
FIG. 4 is a top view of the vacuum footware enclosure of FIG. 1A depicted in a closed and latched position.

FIG. 4 is a top view of the vacuum footware enclosure 100 of FIG. 1A depicted in a closed and latched position. Exoskeletal body 101 is fully closed at tongue-in-groove vacuum interfacing rim 111 with tongue strip 112 fully inserted into groove strip 113 with the sealing ring occupying the lock groove. Closure straps 109 attached to half shell 102*b* are fastened across interfacing rim 111 into snap recesses 110 installed on half shell 102*a* to latch body 101 together.

There may be more closure straps and snap recesses, or fewer closure straps and snap recesses provided without departing from the spirit and scope of the present invention. Closure straps and snap recesses are not necessarily required to keep the enclosure intact to practice the present invention. Vacuum port 104 may accept a vacuum hose fitting in turn connected to a vacuum hose and pump used to pump down the atmosphere within exoskeletal body 101 without collapsing the package. In one embodiment, the vacuum pump used may be a mechanical pump used to draw out the atmosphere to a suitable vacuum tor (pressure) for reducing humidity. In one embodiment the pump may be an electric pump.

Figure 5:
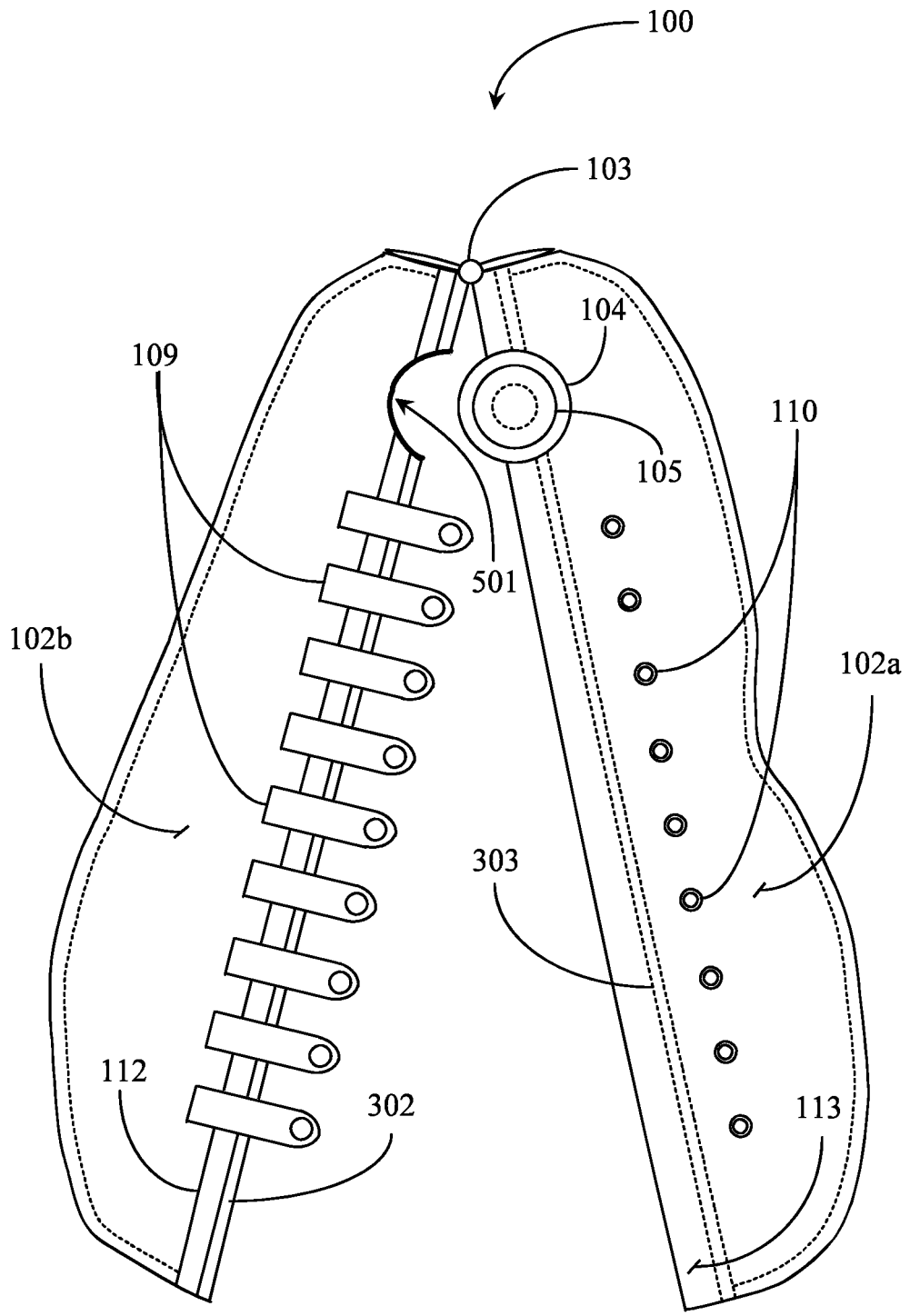
FIG. 5 is a top view of the vacuum footware enclosure of FIG. 4 in an unlatched and open position.

FIG. 5 is a top view of the vacuum footware enclosure 100 of FIG. 4 in an unlatched and open position. In this view, exoskeletal body 101 is depicted unlatched and open for the purpose of accepting a tennis shoe for storage. Closure straps 109 are unsnapped from recesses 110 and the half shells are urged apart mechanically at tongue-in-groove interfacing rim 111 using moderate force to pull tongue strip 112 out of groove strip 113. Hinge 103 allows an angle of swing wide enough to easily position a tennis shoe within the separated half shells 102*a* and 102*b* to be enclosed and stored under a vacuum state.

In this embodiment, vacuum port 104 is located on or overlaps interfacing rim 111 depicted above in FIG. 4. In one embodiment a seal interface 501 may be provided to interface with a groove feature provided for the purpose on the body of the vacuum port thus protecting the vacuum integrity of the closed body beyond interfacing rim 111. Seal interface 501 may be a rubber silicone seal fabricated to fit over the radiused edge on half shell 102*b*. The radius of the edge interfacing port 104 may be the same radius and length as the port body it seals to.

The ends of interfacing rim 111 are closed at port 104 and heat welded to the port connected to half shell 102*a* in this example. In another embodiment, port 104 may be located entirely on one half shell or the other opposing half shell and therefore may not intersect or overlap vacuum interfacing rim 111.

Figure 6:
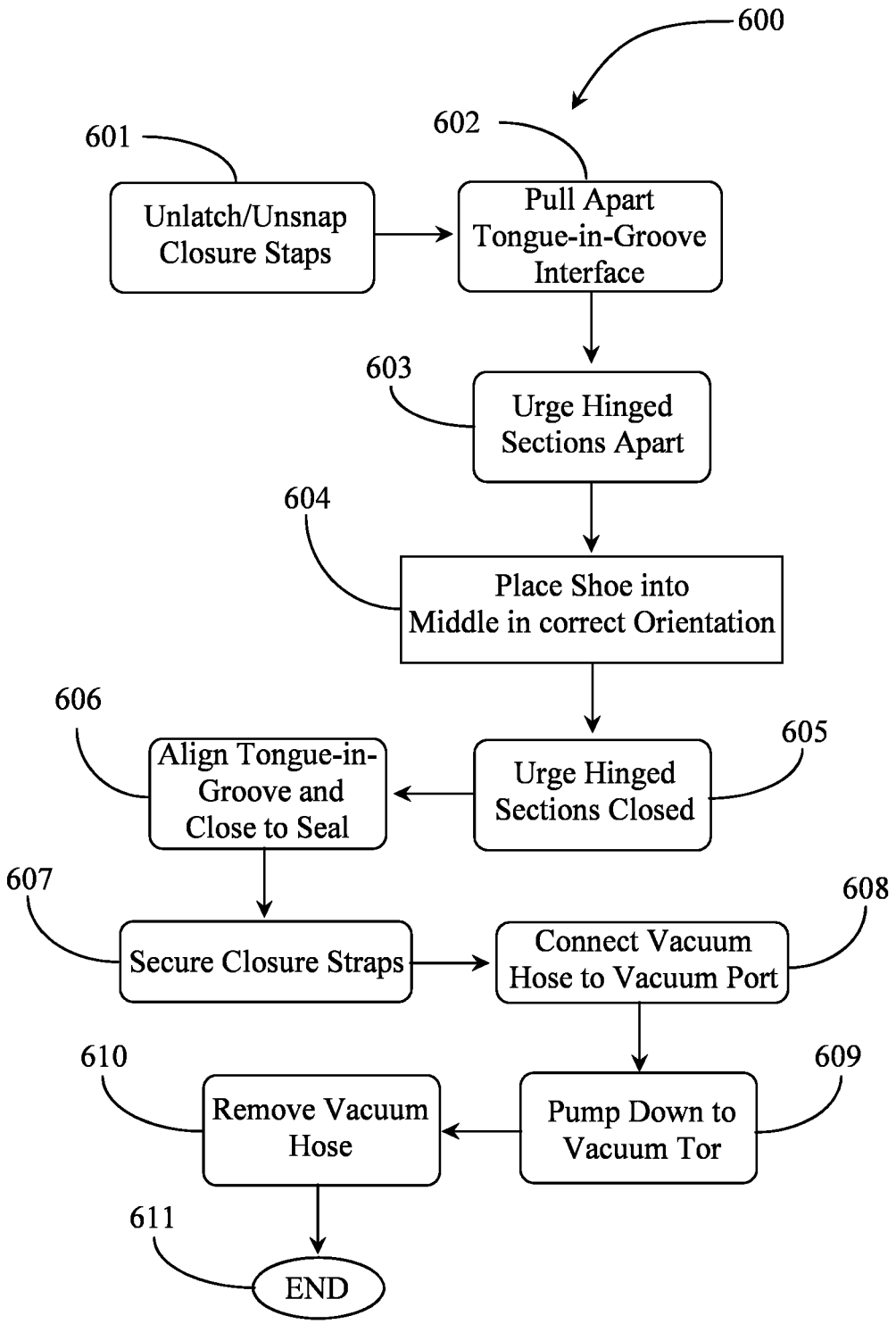
FIG. 6 is a flow chart depicting steps for encapsulating an article of footware for storage using the vacuum footware enclosure of FIG. 1A.

FIG. 6 is a flow chart 600 depicting steps for encapsulating an article of footware for storage using the vacuum footware enclosure of FIG. 1A. At step 601, a user may unlatch and unsnap any closure straps preventing separation of the two half shells of the exoskeletal body. At step 602, the user may pull apart the tongue-in-groove interface. At step 603, the user may urge the half shells apart by operating the hinge to make room for positioning an article of footware within the separated enclosure at the correct orientation.

At step 604, the user may position the article of footware into the middle between the two half shells in correct orientation. In one embodiment, the user may place the article inside one of the open half shells. At step 605, the user may urge the hinged half shell sections toward closing. At step 606, the user may align the tongue strip and groove strip and close the interface to seal with the tongue strip fully bottomed in the groove strip and the seal ring resting in seated position in the lock groove all around the mating half shells.

At step 607, the user may secure any closure straps present by snapping the ends of the straps into the snap recesses provided for the purpose. At step 608, the user may connect a vacuum hose from a pump to the vacuum port. At 609, the user may pump the atmosphere inside the assembled exoskeletal body down to a specified vacuum pressure enough to evacuate the atmosphere of humidity without compromising the materials, or seal. At step 610, the user may remove the vacuum hose from the vacuum port leaving a vacuum within the enclosure maintained by the sealing surfaces of the half shell interface at least, and the port interface in addition. The process may be repeated to store a second article of footware paired with the first article.

In one embodiment, stored pairs of footware may be connected in storage by attaching the vacuum enclosures together by tether or connective strip, etc. The exoskeletal bodies enclosing the footware maintain, in a preferred embodiment, the same shape and profile as the encased footware article without significantly increasing the footprint of the footware article. Therefore, the encapsulated articles may be placed on shoe racks, shelves, and in shoe boxes or bags as typically unprotected articles of footware are without the apparatus of the present invention without requiring much if any space modification for storage.

To remove an article of footware from a vacuum enclosure, a user may push or depress a vacuum release button releasing vacuum pressure within the airtight enclosure, unlatch the half shells by unseating the closure straps if any are present, and pull apart the half shells breaking the tongue-in-groove interface. The user may swing the separated half shells out using the hinge to remove the article of footware.

It will be apparent with skill in the art that the vacuum footware enclosure apparatus of the present invention may be provided using some or all the elements described herein. The arrangement of elements and functionality thereof pertaining to the vacuum footware enclosure apparatus of the invention is described in different embodiments each of which may an implementation of the present invention. While the uses and methods are described in enabling detail herein, it is to be noted that many alterations could be made in the details of the construction and the arrangement of the elements without departing from the spirit and scope of this invention. The present invention is limited only by the breadth of the claims below.

The invention claimed is:

1. An enclosure for encapsulating an article of footware comprising:

a first molded form shaped in manufacture to cover at least a portion of the article of footware, the first form closed at one side and including a peripheral free edge;

a second molded form shaped in manufacture to cover the remaining portion of the article of footware, the second form closed at one side and including a peripheral free edge, the first and second forms align-able to interface at the free edges;

a first peripheral connector strip affixed to a peripheral free edge of the first molded form; and a second peripheral connector strip affixed to the peripheral free edge of the second molded form, a vacuum port having a seal and vacuum pressure release mechanism fixed onto the first or second molded form;

wherein the first peripheral connector strip is plastic welded onto the peripheral free edge of the first molded form and second peripheral connector strip is plastic welded onto the peripheral free edge of the second molded form.

2. The enclosure of claim 1, wherein the first and second molded forms are molded plastic forms of suitable rigidity to maintain form under an applied vacuum pressure.

3. The enclosure of claim 1, wherein the article of footware is one of a tennis shoe, a high heel shoe, a boot, or a sandal.

4. The enclosure of claim 1, wherein the molded forms are fabricated of a translucent polymer.

5. The enclosure of claim 3, wherein the article of footware is a left foot article or a right foot article of a pair of footware articles.

6. The enclosure of claim 1, wherein the vacuum release mechanism is a button that when pressed breaks contact with the vacuum seal in the port.

7. The enclosure of claim 1, further including a plurality of closure straps of a uniform length, width, and thickness, the length dimension enough to enable the straps to extend from the anchoring point on the first molded form to the second molded form.

8. The enclosure of claim 7, wherein the closure straps each include a snap button disposed to and fixed to the free end thereof and wherein the molded form across from the anchoring points of the closure straps include snap recesses installed thereon to accept the snap buttons on the closure straps.

9. The enclosure of claim 1, further including a hinge mounted to the rear surface of the first molded form at one side of the hinge and to the rear surface of the second molded form at the opposing side of the hinge.

10. The enclosure of claim 9, wherein the hinge is a metallic hinge installed to the molded forms by conventional screws.

11. The enclosure of claim 8, wherein the first connective strip includes a wall thickness and a uniform width, and a seal ring affixed thereto along the interface edge of the strip and the second connective strip includes a uniform outside thickness and a peripheral groove having a uniform width, and a uniform depth, the second connector strip further including a peripheral lock groove is formed along the bottom of the peripheral groove, the lock groove having a uniform diameter large enough to catch and seat the peripheral seal ring on the first peripheral connector strip.

* * * * *